US009307609B2

(12) United States Patent
Huang

(10) Patent No.: US 9,307,609 B2
(45) Date of Patent: Apr. 5, 2016

(54) ELECTRONIC DEVICE AND LIGHT-EMITTING MODULE

(71) Applicant: E Ink Holdings Inc., Hsinchu (TW)

(72) Inventor: Hsin-Tao Huang, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 14/092,893

(22) Filed: Nov. 27, 2013

(65) Prior Publication Data

US 2014/0252985 A1 Sep. 11, 2014

(30) Foreign Application Priority Data

Mar. 5, 2013 (TW) ..... 102107652 U

(51) Int. Cl.
*H05B 37/02* (2006.01)
*H05B 33/08* (2006.01)

(52) U.S. Cl.
CPC ..... *H05B 33/0857* (2013.01); *H05B 33/0863* (2013.01); *H05B 37/02* (2013.01)

(58) Field of Classification Search
CPC ..... H05B 33/08; H05B 41/36; H05B 37/02
USPC ..... 315/294, 297, 307, 312
See application file for complete search history.

(56) References Cited

U.S. PATENT DOCUMENTS

2007/0274093 A1* 11/2007 Haim et al. ..... 362/561
2008/0205035 A1* 8/2008 Asvadi et al. ..... 362/103
2008/0224025 A1* 9/2008 Lyons et al. ..... 250/205
2008/0238335 A1 10/2008 Lee et al.
2010/0244701 A1 9/2010 Chen et al.
2011/0285309 A1* 11/2011 Van De Ven ..... H05B 33/0872 315/291
2012/0119662 A1 5/2012 Radermacher
2012/0286666 A1* 11/2012 Shteynberg et al. ..... 315/113

(Continued)

FOREIGN PATENT DOCUMENTS

CN 101876409 A 11/2010
CN 102032459 A 4/2011

(Continued)

OTHER PUBLICATIONS

Corresponding Taiwanese Office Action that these art references were cited.

(Continued)

*Primary Examiner* — Tung X Le
(74) *Attorney, Agent, or Firm* — CKC & Partners Co., Ltd.

(57) ABSTRACT

A light-emitting module includes at least one first light-emitting component, at least one second light-emitting component, a first driving component, a second driving component, and a control component. The first light-emitting component is configured to emit a white light having a first predetermined color temperature according to a first power of a first driving signal. The second light-emitting component is configured to emit another white light having a second predetermined color temperature according to a second power of a second driving signal. The control component is configured to separately output the first and second driving signals, and to separately adjust the first and second powers of the first and second driving signals, so as to mix the white lights having the first and second predetermined color temperatures to output a white light having an output color temperature.

12 Claims, 3 Drawing Sheets

(56) References Cited

U.S. PATENT DOCUMENTS

| | | | | |
|---|---|---|---|---|
| 2012/0286699 | A1 | 11/2012 | Yan et al. | |
| 2013/0082610 | A1 * | 4/2013 | Bradford | H05B 33/0893 315/185 R |

FOREIGN PATENT DOCUMENTS

| | | | |
|---|---|---|---|
| CN | 102095155 | A | 6/2011 |
| CN | 202095150 | U | 12/2011 |
| JP | 2008090270 | A | 4/2008 |
| TW | 200807753 | A | 2/2008 |
| TW | 200935146 | A | 8/2009 |
| TW | 201024595 | A | 7/2010 |
| TW | 201310126 | A | 3/2013 |

OTHER PUBLICATIONS

Corresponding Chinese Office Action that these art references were cited on Sep. 6, 2015.

* cited by examiner

ELECTRONIC DEVICE AND LIGHT-EMITTING MODULE

RELATED APPLICATIONS

This application claims priority to Taiwanese Application Serial Number 102107652, filed Mar. 5, 2013, which is herein incorporated by reference.

BACKGROUND

1. Field of Invention

The present disclosure relates to an electronic device. More particularly, to the present invention relates to an electronic device including a light-emitting module therein.

2. Description of Related Art

With advances in technology, a light-emitting module has been applied to various electronic devices, such as a display device or an e-paper device.

The light-emitting module configured to emit white light can include a red light-emitting diode (LED), a green LED, and a blue LED. The light-emitting module can adjust a color temperature of the white light by adjusting power levels separately provided to the red, green, and blue LEDs. However, in such a configuration, a large mixing area is needed to mix red light, green light, and blue light respectively emitted by the red, green, blue LEDs. Thus, such a restriction limits the degree to which the electronic device can be made thinner and smaller.

Therefore, a light-emitting module with a smaller mixing area and that is capable of emitting white light having an adjustable color temperature is desired.

SUMMARY

One aspect of the present invention is directed to a light-emitting modal. In accordance with one embodiment of the present invention, the light-emitting module is configured to emit a white light having an output color temperature. The light-emitting module includes at least one first light-emitting component, at least one second light-emitting component, a first driving component, a second driving component, and a control component. The first light-emitting component is configured to receive a first driving signal and emit a white light having a first predetermined color temperature according to a first power of the first driving signal. The first light-emitting component includes a first light-emitting unit and a first color temperature conversion unit. The first light-emitting unit is configured to emit a white light having a first original color temperature. The first color temperature conversion unit is configured to convert the white light having the first original color temperature to a white light having a first predetermined color temperature. The second light-emitting component is configured to receive a second driving signal and emit a white light having a second predetermined color temperature according to a second power of the second driving signal. The first driving component is configured to receive the first driving signal and provide the first driving signal to the first light-emitting component. The second driving component is configured to receive the second driving signal and provide the second driving signal to the second light-emitting component. The control component is configured to separately output the first and second driving signals, and configured to separately adjust the first and second powers of the first and second driving signals, so as to mix the white lights having the first and second predetermined color temperatures to output a white light having an output color temperature.

In accordance with one embodiment of the present invention, the first original color temperature is substantially the same as the second predetermined color temperature.

In accordance with one embodiment of the present invention, the second light-emitting component includes a second light-emitting unit and a second color temperature conversion unit. The second light-emitting unit is configured to emit a white light having a second original color temperature. The second color temperature conversion unit is configured to convert the white light having the second original color temperature to the white light having the second predetermined color temperature. In such an embodiment, the first original color temperature is substantially the same as the second original color temperature.

In accordance with one embodiment of the present invention, the light-emitting module further includes a circuit substrate. The first light-emitting unit is disposed on the circuit substrate. The first temperature conversion unit includes a coating coated on the circuit substrate corresponding to a light-emitting direction of the white light emitted by the first light-emitting unit.

In accordance with one embodiment of the present invention, the first temperature conversion unit includes a filter disposed in a light-emitting direction of the white light emitted by the first light-emitting unit.

Another aspect of the present invention is directed to an electronic device. In accordance with one embodiment of the present invention, the electronic device includes a light guide plate and a light-emitting module. The light-emitting module is configured to emit a white light having an output color temperature to the light guide plate. The light-emitting module includes a circuit substrate, at least one first light-emitting component, at least one second light-emitting component, a first driving component, a second driving component, and a control component. The first light-emitting component is disposed on the circuit substrate. The first light-emitting component is configured to receive a first driving signal and emit a white light having a first predetermined color temperature according to a first power of the first driving signal. The first light-emitting component includes a first light-emitting unit and a first color temperature conversion unit. The first light-emitting unit is configured to emit a white light having a first original color temperature. The first color temperature conversion unit is configured to convert the white light having the first original color temperature to the white light having the first predetermined color temperature. The second light-emitting component is configured to receive a second driving signal and emit a white light having a second predetermined color temperature according to a second power of the second driving signal. The first driving component is configured to receive the first driving signal and provide the first driving signal to the first light-emitting component. The second driving component is configured to receive the second driving signal and provide the second driving signal to the second light-emitting component. The control component is configured to separately output the first and second driving signals, and configured to separately adjust the first and second powers of the first and second driving signals, so as to mix the white lights having the first and second predetermined color temperatures in a mixing area to output the white light having the output color temperature.

In accordance with one embodiment of the present invention, the first temperature conversion unit includes a coating.

The coating is coated on the circuit substrate and is located between the first light-emitting unit and the light guide plate.

In accordance with one embodiment of the present invention, the first temperature conversion unit includes a filter. The filter is disposed between the first light-emitting unit and the light guide plate.

In accordance with one embodiment of the present invention, the first original color temperature is substantially the same as the second predetermined color temperature.

In accordance with one embodiment of the present invention, the second light-emitting component includes a second light-emitting unit and a second color temperature conversion unit. The second light-emitting unit is configured to emit a white light having a second original color temperature. The second color temperature conversion unit is configured to convert the white light having the second original color temperature to the white light having the second predetermined color temperature. In such an embodiment, the first original color temperature is substantially the same as the second original color temperature.

In summary, through the application of one embodiment of the present disclosure, an electronic device capable of emitting white light having an adjustable color temperature can be realized By mixing white lights having different color temperatures to generate the white light having the output color temperature, the mixing area of the light-emitting module can be significantly shrunk. In addition, because white light-emitting units (e.g., white LEDs) have characteristics of low cost and high performance, the light-emitting module of the electronic device, that is, the light-emitting module which mixes white lights having different color temperatures emitted by the white light-emitting units, can also have a high light-emitting performance and can be manufactured at a low cost.

Additionally, by application of another embodiment mentioned above, the first and second light-emitting components can be implemented by using substantially identical white LEDs. In such a configuration, the complexity and cost of the light-emitting module of the electronic device can be further reduced.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
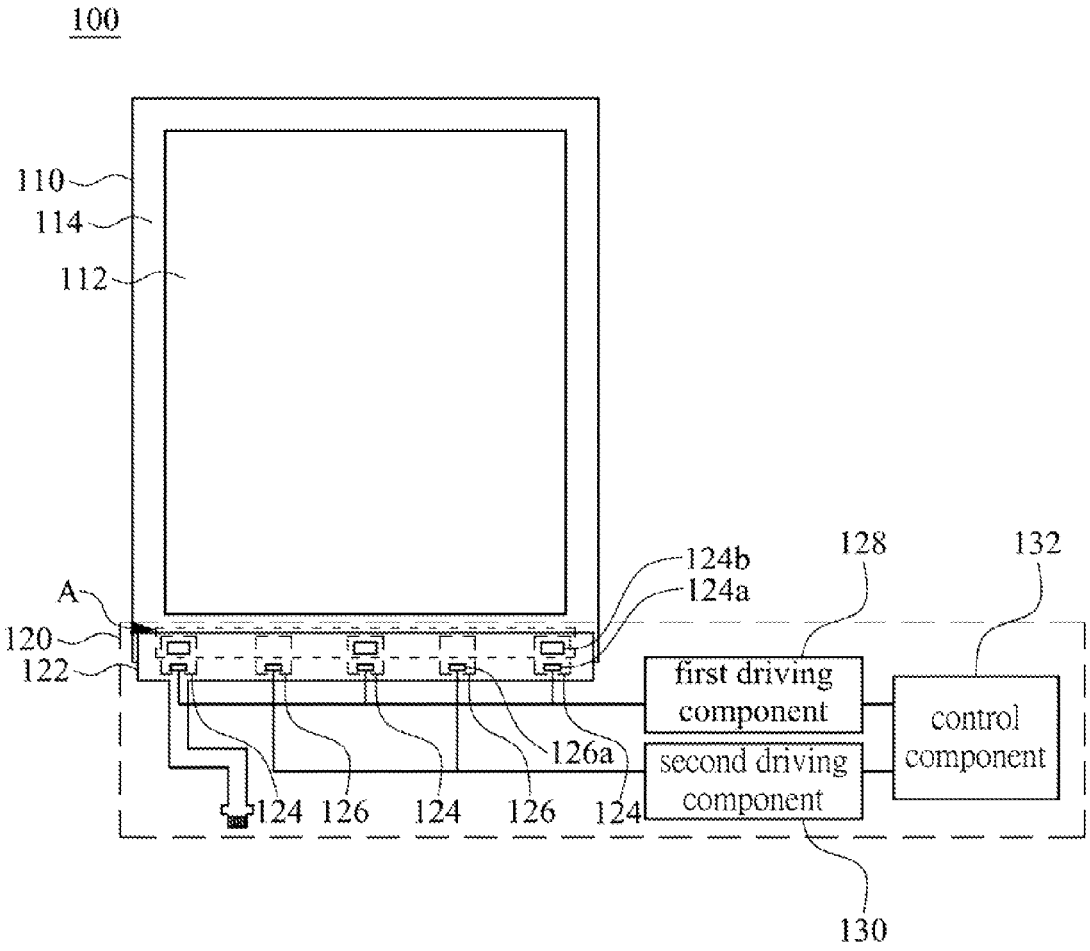
FIG. 1 is a block diagram of an electronic device in accordance with one embodiment of the present disclosure.

In the following detailed description, for purposes of explanation, numerous specific details are set forth in order to attain a thorough understanding of the disclosed embodiments. It will be apparent, however, that one or more embodiments may be practiced without these specific details. In other instances, well-known structures and devices are schematically shown in order to simplify the drawing.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments.

Moreover, it will be understood that "electrically connect" or "connect" used herein can refer to physical contact or electrical contact realized directly or indirectly between two or more elements. "Electrically connect" or "connect" can further refer to the interoperation or interaction between two or more elements.

One aspect of the present invention is an electronic device. The electronic device can be a display device, an e-paper device, and so on. To facilitate the description to follow, an e-paper device will be taken as an example in the following paragraphs.

FIG. 1 is a block diagram of the electronic device 100 in accordance with one embodiment of the present disclosure. The electronic device 100 can include a light guide plate 110 and a light-emitting module 120. The light guide plate 110 can include an active area 112 and a non-active area 114. The light-emitting module 120 can be disposed on at least one side of the light guide plate 110. The light-emitting module 120, for example, is a front light module of the electronic device 100.

In this embodiment, the light-emitting module 120 can include a circuit substrate 122, at least one first light-emitting component 124, at least one second light-emitting component 126, a first driving component 128, a second driving component 130, and a control component 132. The first light-emitting component 124 and the second light-emitting component 126 can be disposed on the circuit substrate 122. The first driving component 128 can be electrically connected to the first light-emitting component 124 and the control component 132. The second driving component 130 can be electrically connected to the second light-emitting component 126 and the control component 132.

The first light-emitting component 124 is configured to receive a first driving signal (e.g., voltage, current, pulse width modulation signal, and so on) transmitted by the control component 132 through the first driving component 128, and configured to emit a white light having a first predetermined color temperature (e.g., 8900 K) according to a first power of the first driving signal.

The second light-emitting component 126 is configured to receive a second driving signal (e.g., voltage, current, pulse width modulation signal, and so on) transmitted by the control component 132 through the second driving component 130, and is configured to emit a white light having a second predetermined color temperature (e.g., 5400 K) according to a second power of the second driving signal. The first predetermined color temperature is different from the second predetermined color temperature. The first light-emitting component 124 and the second light-emitting component 126 can, for example, be separately realized by white light emit diodes (LEDs) corresponding to different bins, or be separately realized by other components configured to emit white lights having different color temperatures (details in this regard will be described in the paragraphs below).

The first driving component 128 can be configured to receive the first driving signal transmitted from the control component 132, and to provide the first driving signal to the first light-emitting component 124.

The second driving component 130 can be configured to receive the second driving signal transmitted from the control component 132, and to provide the second driving signal to the second light-emitting component 126. The first driving component 128 and the second driving component 130, for example are driving circuits independent of each other. It should be noted that the first driving component 128 can receive the first driving signal and provide the first driving signal in different forms. Purely by way of a non-limiting example, the first driving component 128 can receive a voltage signal and provide a current signal to the first light-emitting component 124. Similarly, the second driving component 130 can receive the second driving signal and provide the second driving signal in different forms.

The control component 132 can be configured to separately output the first driving signal and the second driving signal, and to separately adjust the first power of the first driving signal and the second power of the second driving signal (e.g., adjust the voltages, the currents, the pulse modulation signals, and/or the frequencies of the first and second driving signals), so as to mix the white light having the first predetermined color temperature and the white light having the second predetermined color temperature in a mixing area A to generate a white light having a specific output color temperature (e.g., 8900K-5400K). The mixing area A can be located in the air or in a portion of the non-active area 114 of the light guide plate 110. The control component 132, for example, can be implemented by electrical circuits or other devices that one skilled in the art would be able to contemplate.

Figure 2:
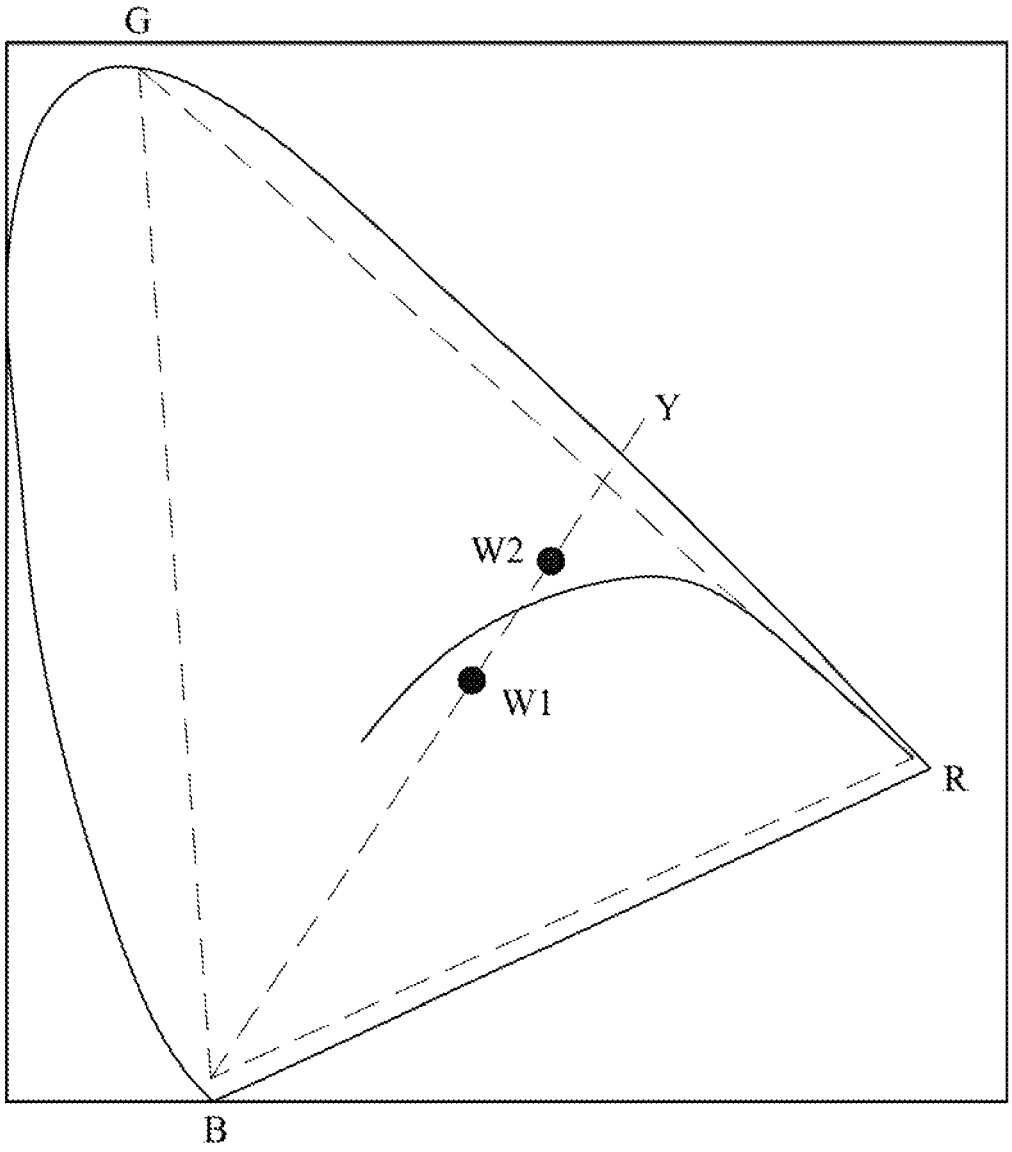
FIG. 2 is a diagram illustrating a first predetermined color temperature and a second predetermined color temperature of the electronic device on a CIE 1931 color space chromaticity diagram in accordance with one embodiment of the present disclosure.

Reference is made also to FIG. 2, which is a diagram illustrating the first predetermined color temperature and the second predetermined color temperature of the electronic device 100 on a CIE 1931 color space chromaticity diagram in accordance with one embodiment of the present disclosure. Line B-Y can correspond to color temperatures of white lights. The first predetermined color temperature corresponds to point W1, and the second predetermined color temperature corresponds to point W2. The control component 132 can separately adjust the first power of the first driving signal and the second power of the second driving signal, such that the light-emitting module 120 can emit the white light having the color temperature corresponding to a point between points W1, W2 by mixing the white lights having the first predetermined color temperature and the second predetermined color temperature.

In such a configuration, an electronic device capable of emitting white light having an adjustable color temperature can be implemented. In addition, compared to a traditional light-emitting module mixing red light, green light, and blue light (e.g., respectively corresponding to end points R, G, B shown in FIG. 2), the mixing area A of the light-emitting module 120 of the electronic device 100 in this application can be significantly shrunk (e.g., the length of the mixing area A can be smaller than 10 mm) by mixing white lights having different color temperatures.

Moreover, because white light-emitting units (e.g., white LEDs) have characteristics of low cost and high performance, compared to the traditional light-emitting module mixing red light, green light, and blue light, the light-emitting module 120 of the electronic device 100 in this application can have a higher light-emitting performance and can be manufactured at a lower cost.

In accordance with one embodiment of the present invention, the first light-emitting component 124, for example, can include a first light-emitting unit 124*a* and a first color temperature conversion unit 124*b*. The first light-emitting unit 124*a*, for example, can be an LED, and can be disposed on the circuit substrate 122. The first light-emitting unit 124*a* can be configured to emit a white light having a first original color temperature (e.g., 5400K) toward the light guide plate 110 according to the first driving signal. The first color temperature conversion unit 124*b* can be disposed corresponding to the first light-emitting unit 124*a*, and can be configured to convert the white light having the first original color temperature to the white light having the first predetermined color temperature (e.g., 8900K).

For example, the first color temperature conversion unit 124*b* can include a coating, and the coating is coated on the circuit substrate 122 corresponding to a light-emitting direction of the white light emitted by the first light-emitting unit 124*a* and is located between the first light-emitting unit 124*a* and the light guide plate 110.

As another example, the first color temperature conversion unit 124*b* can include a filter, and the filter is disposed in a light-emitting direction of the white light emitted by the first light-emitting unit 124*a*, and is located between the first light-emitting unit 124*a* and the light guide plate 110.

On the other hand, the second light-emitting component 126, for example, can include only a second light-emitting unit 126*a*.

The second light-emitting unit 126*a*, for example, can be an LED, and can be disposed on the circuit substrate 122. The second light-emitting unit 126*a* can be configured to emit the white light having the second predetermined color temperature (e.g., 5400K) toward the light guide plate 110 according to the second driving signal. The second predetermined color temperature, for example, can be substantially the same as the first original color temperature. In other words, the white lights emitted by the first light-emitting unit 124*a* and the second light-emitting unit 126*a* can, for example, have substantially the same color temperatures.

In such a configuration, the first and second light-emitting components 124, 126 configured to emit white lights having different color temperatures can be implemented. Compared to implementing the first and second light-emitting components 124, 126 by using different white LEDs, by using substantially identical white light-emitting diodes for the first and second light-emitting components, the complexity and the cost of the light-emitting module 120 of the electronic device 100 can be further reduced.

Figure 3:
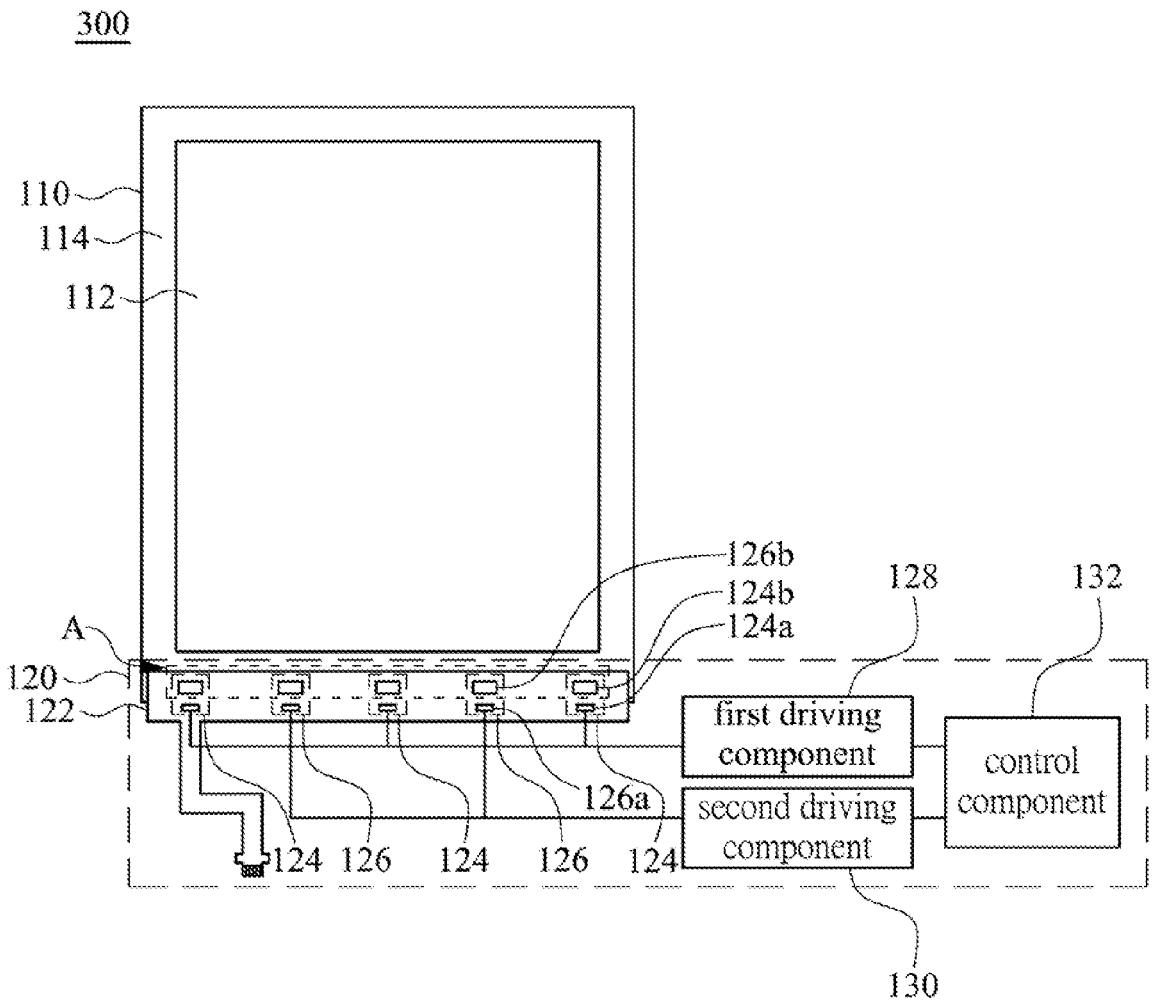
FIG. 3 is a block diagram of the electronic device in accordance with another embodiment of the present disclosure.

FIG. 3 is a block diagram of the electronic device 300 in accordance with another embodiment of the present disclosure. The configuration of the electronic device 300 is similar to that of the electronic device 100 in FIG. 1, and therefore, a description of many aspects that are similar will not be repeated.

In the electronic device 300, the first light-emitting component 124, for example, can include the first light emitting unit 124*a* and the first color temperature conversion unit 124*b*. The first light-emitting unit 124*a*, for example, can be an LED, and can be disposed on the circuit substrate 122. The first light-emitting unit 124*a* can be configured to emit the white light having the first original color temperature (e.g., 7500K) toward the light guide plate 110 according to the first driving signal. The first color temperature conversion unit 124*b* can be disposed corresponding to the first light-emitting unit 124*a*, and can be configured to convert the white light having the first original color temperature to the white light having the first predetermined color temperature (e.g., 8900K). The implementation of the first color temperature conversion unit 124*b* can be ascertained by referring to the above paragraphs, and a description in this regard will not be repeated herein.

The second light-emitting component 126, for example, can include the second light emitting unit 126*a* and a second color temperature conversion unit 126*b*. The second light-emitting unit 126*a*, for example, can be an LED, and can be disposed on the circuit substrate 122. The second light-emitting unit 126*a* can be configured to emit white light having a second original color temperature (e.g., 7500K) toward the light guide plate 110 according to the second driving signal. The second color temperature conversion unit 126*b* can be disposed corresponding to the second light-emitting unit 126*a*, and can be configured to convert the white light having the second original color temperature to the white light having the second predetermined color temperature (e.g., 5400K).

For example, the second color temperature conversion unit 126*b* can include a coating, and the coating is coated on the circuit substrate 122 corresponding to a light-emitting direction of the white light emitted by the second light-emitting unit 126*a* and is located between the second light-emitting unit 126*a* and the light guide plate 110.

As another example, the second color temperature conversion unit 126*b* can include a filter, and the filter is disposed in a light-emitting direction of the white light emitted by the second light-emitting unit 126*a*, and is located between the second light-emitting unit 126*a* and the light guide plate 110.

In this embodiment, the second original color temperature, for example, is substantially the same as the first original color temperature. In other words, the white lights emitted by the first light-emitting unit 124*a* and the second light-emitting unit 126*a* can, for example, have substantially the same color temperatures.

In such a configuration, the first and second light-emitting components 124, 126 configured to emit white lights having different color temperatures can be implemented. Compared to implementing the first and second light-emitting components 124, 126 by using white LEDs having different original color temperature, by using white LEDs having substantially identical original color temperature for the first and second light-emitting components 124, 126, the complexity and the cost of the light-emitting module 120 of the electronic device 100 can be further reduced.

It should be noted that although a front light module of an e-paper device is taken as an example in the embodiment above, in practice, the light-emitting module in this application can serve as a white light source in other devices (e.g., a backlight module of a liquid crystal display device), and is not limited by the application in the embodiment described above.

In addition, although the light-emitting module is described as having two light-emitting components and two driving components in the embodiment above, in practice, the light-emitting module can have three or more light-emitting components and driving components, and is not limited by the embodiment described above.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A light-emitting module configured to emit a white light having an output color temperature, wherein the light-emitting module comprises:

at least one first light-emitting component configured to receive a first driving signal and emit a white light having a first predetermined color temperature according to a first power of the first driving signal, wherein the first light-emitting component comprises:

a first light-emitting unit configured to emit a white light having a first original color temperature; and a first color temperature conversion unit configured to convert the white light having the first original color temperature to the white light having the first predetermined color temperature;

at least one second light-emitting component configured to receive a second driving signal and emit a white light having a second predetermined color temperature according to a second power of the second driving signal;

a first driving component configured to receive the first driving signal and provide the first driving signal to the first light-emitting component;

a second driving component configured to receive the second driving signal and provide the second driving signal to the second light-emitting component; and a control component configured to separately output the first and second driving signals, and configured to separately adjust the first and second powers of the first and second driving signals, so as to mix the white lights having the first and second predetermined color temperatures to output a white light having an output color temperature, wherein a value of the first predetermined color temperature is about 8900K, a value of the second predetermined color temperature is about 5400K and a value of the output color temperature is between 5400K and 8900K.

2. The light-emitting module as claimed in claim 1, wherein the first original color temperature is substantially the same as the second predetermined color temperature.

3. The light-emitting module as claimed in claim 1, wherein the second light-emitting component comprises:

a second light-emitting unit configured to emit a white light having a second original color temperature, and a second color temperature conversion unit configured to convert the white light having the second original color temperature to the white light having the second predetermined color temperature.

4. The light-emitting module as claimed in claim 3, wherein the first original color temperature is substantially the same as the second original color temperature.

5. The light-emitting module as claimed in claim 1 further comprising a circuit substrate, wherein the first light-emitting unit is disposed on the circuit substrate, the first temperature conversion unit comprises a coating, and the coating is coated on the circuit substrate corresponding to a light-emitting direction of the white light emitted by the first light-emitting unit.

6. The light-emitting module as claimed in claim 1, wherein the first temperature conversion unit comprises a filter, and the filter is disposed in a light-emitting direction of the white light emitted by the first light-emitting unit.

7. An electronic device, comprising:

a light guide plate; and a light-emitting module configured to emit a white light having an output color temperature to the light guide plate, wherein the light-emitting module comprises:

a circuit substrate;

at least one first light-emitting component disposed on the circuit substrate, wherein the first light-emitting component is configured to receive a first driving signal and emit a white light having a first predetermined color temperature according to a first power of the first driving signal, and the first light-emitting component comprises:

a first light-emitting unit configured to emit a white light having a first original color temperature; and a first color temperature conversion unit configured to convert the white light having the first original color temperature to the white light having the first predetermined color temperature;

at least one second light-emitting component configured to receive a second driving signal and emit a white light having a second predetermined color temperature according to a second power of the second driving signal;

a first driving component configured to receive the first driving signal and provide the first driving signal to the first light-emitting component;

a second driving component configured to receive the second driving signal and provide the second driving signal to the second light-emitting component; and a control component configured to separately output the first and second driving signals, and configured to separately adjust the first and second powers of the first and second driving signals, so as to mix the white lights having the first and second predetermined color temperatures in a mixing area to output the white light having the output color temperature, wherein a value of the first predetermined color temperature is about 8900K, a value of the second predetermined color temperature is about 5400K and a value of the output color temperature is between 5400K and 8900K.

8. The electronic device as claimed in claim 7, wherein the first temperature conversion unit comprises a coating, and the coating is coated on the circuit substrate and is located between the first light-emitting unit and the light guide plate.

9. The electronic device as claimed in claim 7, wherein the first temperature conversion unit comprises a filter, and the filter is disposed between the first light-emitting unit and the light guide plate.

10. The electronic device as claimed in claim 7, wherein the first original color temperature is substantially the same as the second predetermined color temperature.

11. The electronic device as claimed in claim 7, wherein the second light-emitting component comprises:

a second light-emitting unit configured to emit a white light having a second original color temperature; and a second color temperature conversion unit configured to convert the white light having the second original color temperature to the white light having the second predetermined color temperature.

12. The electronic device as claimed in claim 7, wherein the first original color temperature is substantially the same as the second original color temperature.

* * * * *